US009499235B1

(12) United States Patent
Blavat

(10) Patent No.: US 9,499,235 B1
(45) Date of Patent: Nov. 22, 2016

(54) KAYAK PADDLE HOLDER

(71) Applicant: Michael A. Blavat, Marinette, WI (US)

(72) Inventor: Michael A. Blavat, Marinette, WI (US)

( * ) Notice: Subject to any disclaimer, the term of this patent is extended or adjusted under 35 U.S.C. 154(b) by 0 days.

(21) Appl. No.: 13/771,118

(22) Filed: Feb. 20, 2013

Related U.S. Application Data

(60) Provisional application No. 61/644,084, filed on May 8, 2012.

(51) Int. Cl.
*B63B 35/00* (2006.01)
*B63B 17/00* (2006.01)

(52) U.S. Cl.
CPC ..... *B63B 17/00* (2013.01)

(58) Field of Classification Search
CPC ..... B63B 2035/715; B63B 17/00
USPC ..... 114/347
See application file for complete search history.

(56) References Cited

U.S. PATENT DOCUMENTS

| | | | | |
|---|---|---|---|---|
| 5,087,005 | A * | 2/1992 | Holoff et al. | 248/205.8 |
| 7,810,777 | B2 * | 10/2010 | Paradise et al. | 248/362 |
| 8,480,045 | B2 * | 7/2013 | Adams, IV | 248/206.2 |
| 2006/0011566 | A1 * | 1/2006 | Guy | 211/60.1 |
| 2008/0016658 | A1 * | 1/2008 | Kutny Splaine | 24/457 |
| 2012/0067911 | A1 * | 3/2012 | Norment | 220/735 |

* cited by examiner

*Primary Examiner* — Stephen Avila
(74) *Attorney, Agent, or Firm* — Donald J. Ersler

(57) ABSTRACT

A kayak paddle holder includes a handle retention clip and at least one suction cup. The handle retention clip includes a lengthwise body and a pair of opposing lips. The lengthwise body includes an inner perimeter, which is sized to receive a handle of a kayak paddle. The pair of opposing lips extend inward from opposing edges of the lengthwise body. Each suction cup includes a suction cup portion and a mounting portion. The suction cup portion is retained by the mounting portion. The mounting portion is preferably attached to the handle retention clip with at least one fastener. The suction cup may be replaced with a twist lock suction cup. It is preferable to attach one suction cup to each end of the handle retention clip. In use, the at least one suction cup is secured to a flat surface on a kayak.

10 Claims, 4 Drawing Sheets

KAYAK PADDLE HOLDER

CROSS-REFERENCES TO RELATED APPLICATIONS

This is a nonprovisional patent application taking priority from provisional application No. 61/644,084 filed on May 8, 2012.

BACKGROUND OF THE INVENTION

1. Field of the Invention

The present invention relates generally to kayaks and more specifically to a kayak paddle holder, which uses suction cups for securing the kayak paddle to a body of a kayak instead of fasteners.

2. Discussion of the Prior Art

It is well known in the art to secure a paddle to a kayak with a paddle holder. However, the paddle holder must be secured to a body of the kayak with fasteners. Using fasteners requires that holes be drilled through the body of the kayak to secure the paddle holder. However, drilling holes may damage the structural integrity of the kayak or allow water to enter the kayak at a later date.

Accordingly, there is a clearly felt need in the art for a kayak paddle holder, which retains a kayak paddle on a kayak without the necessity to drill holes through the kayak for attachment of the kayak paddle holder with fasteners.

SUMMARY OF THE INVENTION

The present invention provides a kayak paddle holder, which retains a kayak paddle without the necessity for attachment with fasteners. The kayak paddle holder includes a handle retention clip and at least one suction cup. The handle retention clip includes a lengthwise body and a pair of opposing lips. The lengthwise body includes an inner perimeter, which is sized to receive a handle of a kayak paddle. The inner perimeter preferably has a substantially semi-circular shape. The pair of opposing lips extend inward from opposing edges of the lengthwise body. Each suction cup includes a suction cup portion and a mounting portion. The suction cup portion is retained by the mounting portion. The mounting portion is preferably attached to the handle retention clip with at least one fastener. The suction cup may be replaced with a twist lock suction cup. It is preferable to attach one suction cup to each end of the handle retention clip.

In use, the at least one suction cup is secured to a flat surface on a kayak. If the twist lock suction cup is used, twist levers thereof are rotated to lock the at least one twist lock suction cup to a flat surface on the kayak. The handle of the kayak paddle is then snapped into the handle retention clip and retained by the pair of opposing lips.

Accordingly, it is an object of the present invention to provide a kayak paddle holder, retains a kayak paddle on a kayak without the necessity to drill holes through the kayak for attachment of the kayak paddle holder with fasteners.

These and additional objects, advantages, features and benefits of the present invention will become apparent from the following specification.

DETAILED DESCRIPTION OF THE PREFERRED EMBODIMENTS

Figure 1:
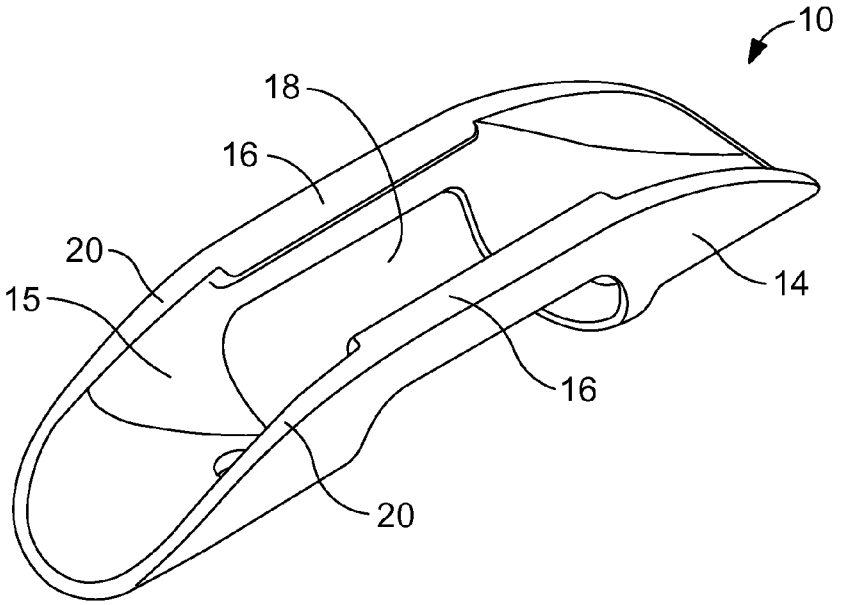
FIG. 1 is a perspective view of a kayak paddle holder in accordance with the present invention.
Figure 2:
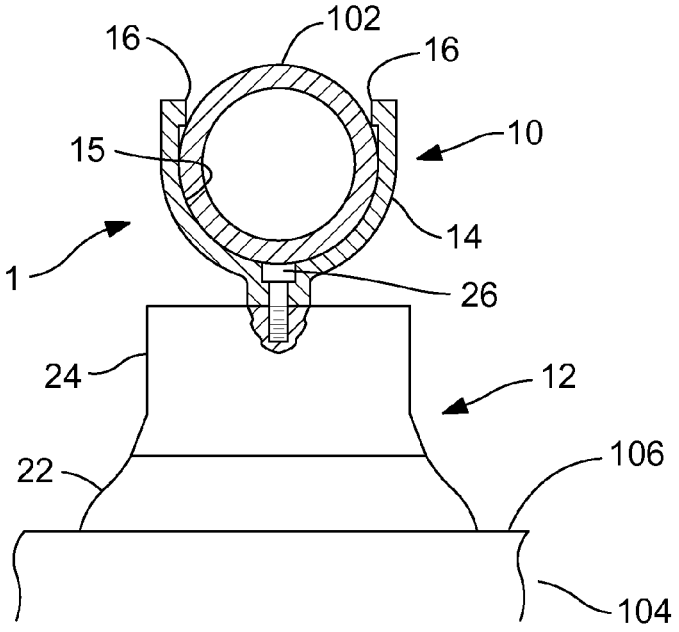
FIG. 2 is a cross sectional view of a kayak paddle holder secured to a kayak in accordance with the present invention.
Figure 3:
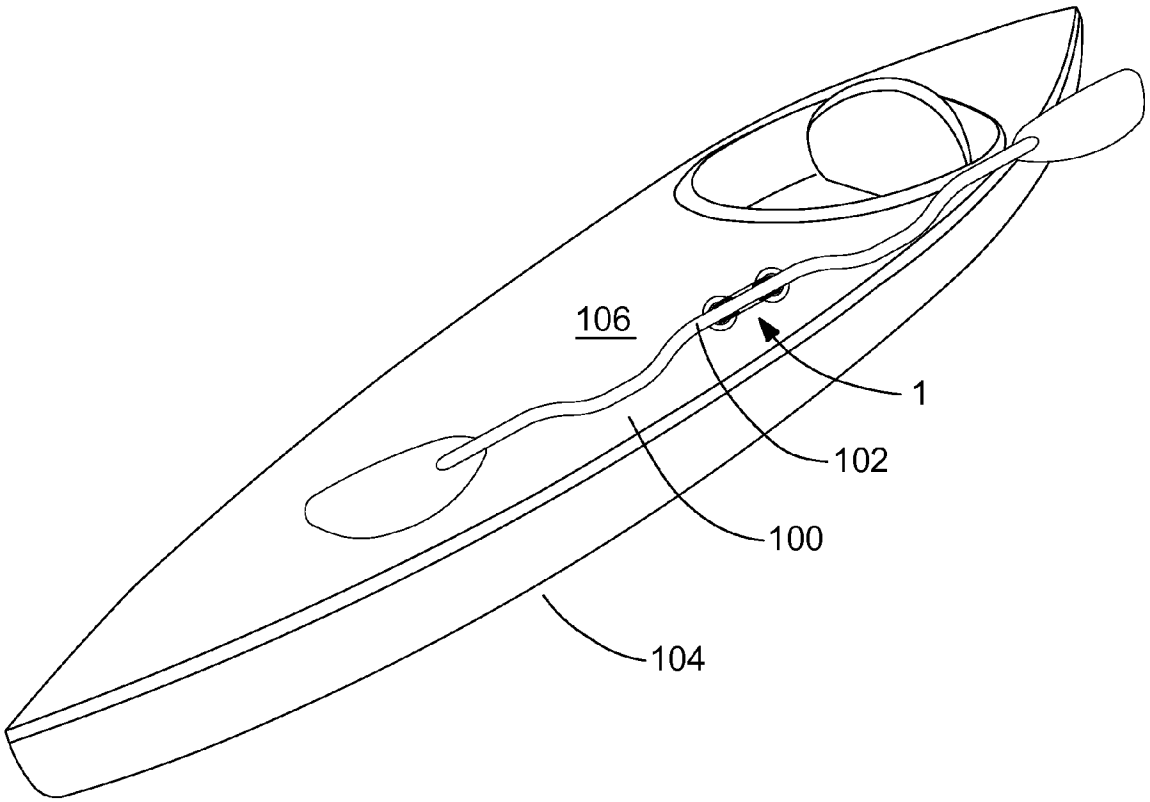
FIG. 3 is a perspective view of a kayak paddle holder secured to a kayak in accordance with the present invention.
Figure 4:
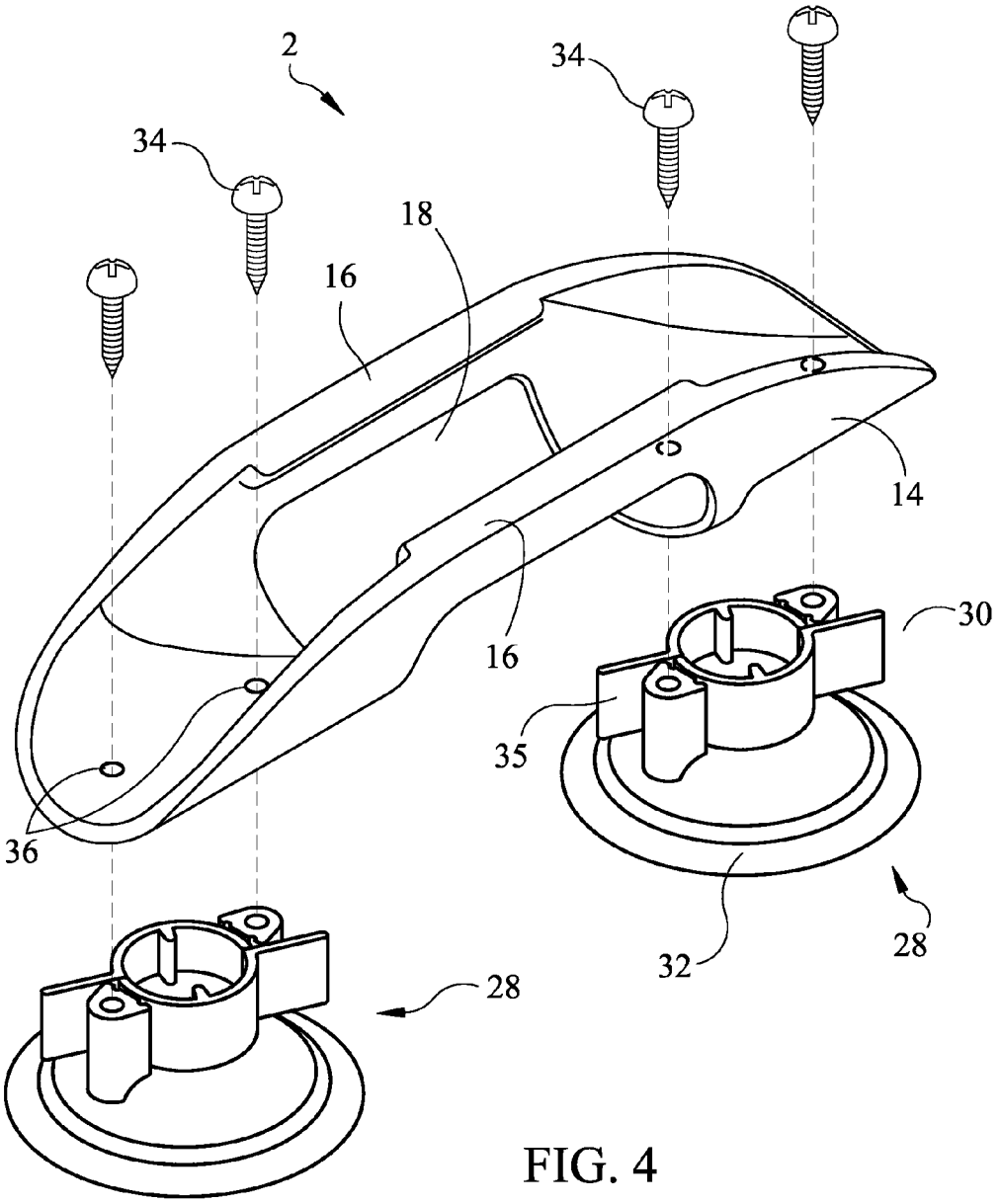
FIG. 4 is an exploded perspective view of a kayak paddle holder with twist lock suction cups in accordance with the present invention.
Figure 5:
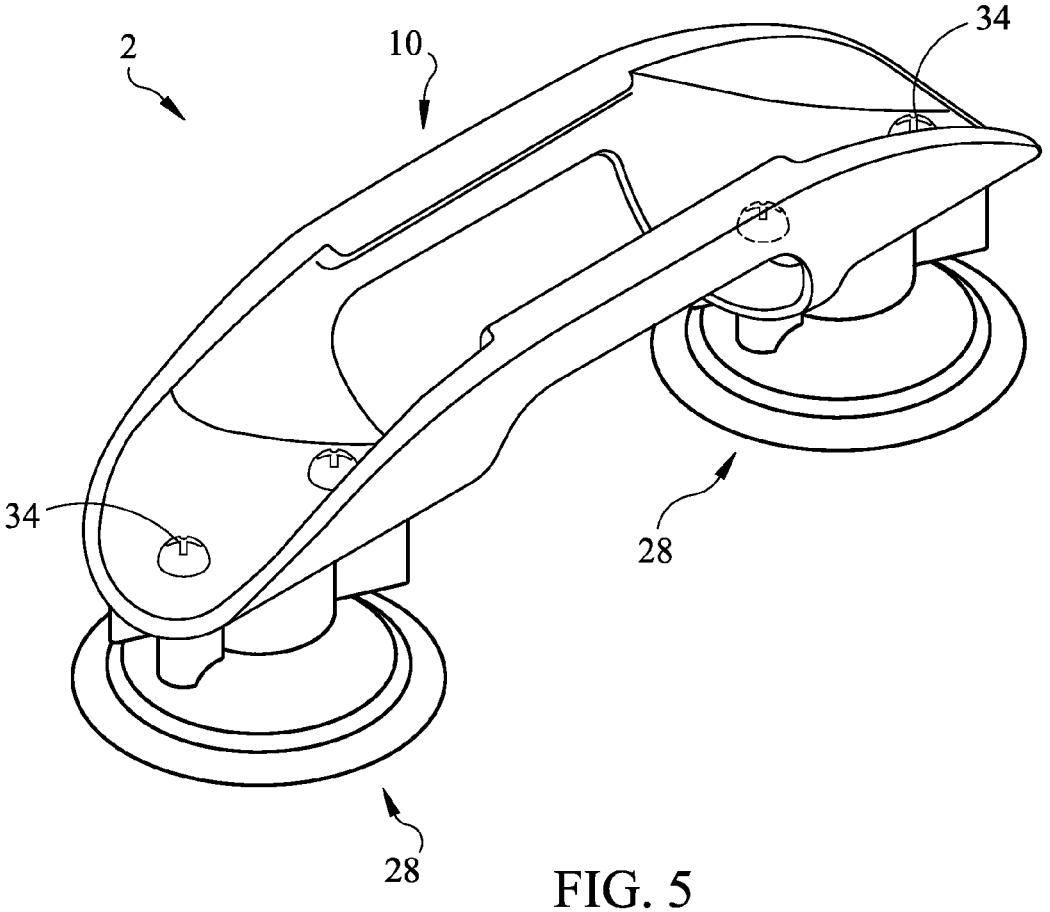
FIG. 5 is a perspective view of a kayak paddle holder with twist lock suction cups in accordance with the present invention.

With reference now to the drawings, and particularly to FIG. 1, there is shown a perspective view of a kayak paddle holder 1. With reference to FIGS. 2-3, the kayak paddle holder 1 includes a handle retention clip 10 and at least one suction cup 12. The handle retention clip 10 includes a lengthwise body 14 and a pair of opposing lips 16. The lengthwise body includes an inner perimeter 15, which is sized to receive a handle of a kayak paddle. The inner perimeter 15 preferably has a substantially semi-circular shape, but other shapes could also be used. A material reduction opening 18 is preferably formed through a middle of the lengthwise body 14 to increase flexibility and to decrease the amount of material required for manufacture. The pair of opposing lips 16 extend inward toward each other from opposing edges 20 of the lengthwise body 14. The handle retention clip 10 is preferably fabricated from a flexible plastic material having memory properties to allow a handle 102 of a kayak paddle 100 to be inserted past the pair of opposing lips 16 and retained by the pair of opposing lips 16.

Each suction cup 12 includes a suction cup portion 22 and a mounting portion 24. The suction cup portion 22 is retained by the mounting portion 24. Suction cups are well known in the art and need not be explained in further detail. The mounting portion 24 is preferably attached to the lengthwise body 14 with at least one fastener 26. It is preferable to attach one suction cup 12 to each end of the handle retention clip 10. The suction cup 12 may be replaced with a twist lock suction cup 28 to create a kayak paddle holder 2. The twist lock suction cup 28 includes a suction cup portion 30 and a locking portion (mounting portion) 32. The suction cup portion 30 is retained by the locking portion 32. The locking portion 32 includes a twist lever 35. Twist lock suction cups 32 may be purchased from Ram Mounts of Seattle, Wash. The locking portion 32 is attached to the lengthwise body 14 by inserting two fasteners 34 through two holes 36 and tightening the two fasteners 34. It is preferable to attach one twist lock suction cup 32 to each end of the handle retention clip 10.

In use, the at least one suction cup 12 is secured to a flat surface 106 on a kayak 104. The at least one twist lock suction cup 32 is secured to a flat surface 106 on a kayak 104 by rotating the twist lever 35. The handle 102 of the kayak paddle 10 is then snapped into the handle retention clip 10 and retained in the inner perimeter 15 by the pair of opposing lips 16.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A kayak paddle holder comprising:

a handle retention clip includes a lengthwise body and a pair of opposing lips, said lengthwise body includes an outer perimeter and an inner perimeter, said inner and outer perimeters having a substantially semi-circular shape, said pair of opposing lips extend inward from opposing edges of said lengthwise body, a length of said pair of opposing lips is greater than a distance between said opposing lips, said inner perimeter is sized to receive a handle of a kayak paddle, a material reduction opening is formed through said lengthwise body directly below said pair of opposing lips, said lengthwise body includes a first support portion and a second support portion, said first support portion extends beyond a length of said pair of opposing lips from a first end of said opposing lips, said second support portion extends beyond a length of said pair of opposing lips from a second end of said opposing lips, said first and second support portions make contact with the handle; and at least one suction cup, each one of said at least one suction cup includes a suction cup portion and a mounting portion, said mounting portion is secured to a bottom of said lengthwise body.

2. The kayak paddle holder of claim 1 wherein:

said handle retention clip is fabricated from a flexible material having memory properties.

3. The kayak paddle holder of claim 1 wherein:

one of said at least one suction cup is retained on each end of said lengthwise body.

4. The kayak paddle holder of claim 1 wherein:

said mounting portion is attached to said lengthwise body with at least one fastener.

5. The kayak paddle holder of claim 1 wherein:

each one of said at least one suction cup is a twist lock suction cup, said mounting portion includes a lock lever.

6. A kayak paddle holder comprising:

a handle retention clip includes a lengthwise body and a pair of opposing lips, said lengthwise body includes an outer perimeter and inner perimeter, said inner and outer perimeters having a substantially semi-circular shape, said pair of opposing lips extend inward from opposing edges of said lengthwise body, a length of said pair of opposing lips is greater than a distance between said opposing lips, a material reduction opening is formed through said lengthwise body directly below said pair of opposing lips, said lengthwise body includes a first support portion and a second support portion, said first support portion extends beyond a length of said pair of opposing lips from a first end of said opposing lips, said second support portion extends beyond a length of said pair of opposing lips from a second end of said opposing lips, said first and second support portions make contact with the handle; and at least one twist lock suction cup, each one of said at least one suction cup includes a suction cup portion and a locking portion, said mounting portion is secured to a bottom of said lengthwise body.

7. The kayak paddle holder of claim 6 wherein:

said handle retention clip is fabricated from a flexible material having memory properties.

8. The kayak paddle holder of claim 6 wherein:

one of said at least one suction cup is retained on each end of said lengthwise body.

9. The kayak paddle holder of claim 6 wherein:

said mounting portion is attached to said lengthwise body with at least one fastener.

10. The kayak paddle holder of claim 6 wherein:

each one of said at least one suction cup is a twist lock suction cup, said mounting portion includes a lock lever.

* * * * *